US009223274B2

(12) United States Patent
Miyahara

(10) Patent No.: US 9,223,274 B2
(45) Date of Patent: Dec. 29, 2015

(54) PRINTING APPARATUS, METHOD FOR CONTROLLING PRINTING APPARATUS, AND STORAGE MEDIUM

(71) Applicant: CANON KABUSHIKI KAISHA, Tokyo (JP)

(72) Inventor: Nobuaki Miyahara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/095,796

(22) Filed: Dec. 3, 2013

(65) Prior Publication Data

US 2014/0161476 A1 Jun. 12, 2014

(30) Foreign Application Priority Data

Dec. 6, 2012 (JP) ..... 2012-267328

(51) Int. Cl.
*G03G 15/00* (2006.01)

(52) U.S. Cl.
CPC .. *G03G 15/5004* (2013.01); *G03G 2215/00734* (2013.01)

(58) Field of Classification Search
CPC ..... G03G 15/607; G03G 15/6514; G03G 15/5004; G03G 15/65; G03G 15/6502; G03G 15/6508
USPC ..... 399/45, 37, 370
See application file for complete search history.

(56) References Cited

U.S. PATENT DOCUMENTS

2010/0253965 A1* 10/2010 Ogisu ..... 358/1.14
2010/0260506 A1* 10/2010 Naruse ..... 399/9

FOREIGN PATENT DOCUMENTS

JP 8-234876 A 9/1996

* cited by examiner

*Primary Examiner* — Clayton E Laballe
*Assistant Examiner* — Ruifeng Pu
(74) *Attorney, Agent, or Firm* — Canon USA, Inc. IP Division

(57) ABSTRACT

A printing apparatus includes a power control unit, a detecting unit, and a determining unit. The power control unit controls power supply to an operation unit, an engine unit, and a controller unit. The detecting unit detects a size of a sheet held in a sheet holding unit. The determining unit determines, after the printing apparatus is shifted to a power saving state which restricts power supply to the operation unit, the engine unit, and the controller unit, whether a size of a sheet specified in a received job and the detected size match each other. Where the determining unit determines that the detected and specified size of the sheets match each other, the power control unit supplies power to the controller engine units while maintaining the restriction on power supply to the operation unit, and shifts the printing apparatus to the power saving state after the job ends.

6 Claims, 11 Drawing Sheets

PRINTING APPARATUS, METHOD FOR CONTROLLING PRINTING APPARATUS, AND STORAGE MEDIUM

BACKGROUND OF THE INVENTION

1. Field of the Invention

The present invention relates to a printing apparatus, a method for controlling the printing apparatus, and a storage medium.

2. Description of the Related Art

A printing apparatus including a manual feed tray which allows various types of sheets to be placed and passed has conventionally been known. This manual feed tray allows a user to pass not only a standard-size sheet but also an envelope, a postcard, and further a non-standard-size sheet through the printing apparatus, and to directly place the sheet on a sheet feeding port. Therefore, considering the prevention of the sheet from being suddenly pulled in, the size of the sheet cannot be determined unless a setting for the sheet is completed on an operation panel.

On the other hand, in recent years, from a viewpoint of energy saving, there have exited printing apparatuses capable of performing power control for each of a plurality of units (see Japanese Patent Application Laid-Open No. 8-234876). These printing apparatuses have a sleep mode that energizes only the required minimum portion to be used by gradually reducing power to the units thereof when the printing apparatuses have not operated for a predetermined time. Thus, the sleep mode can achieve energy saving while maintaining usability. The sleep mode is enabled particularly on condition that the printing apparatuses have not operated for a predetermined time. Thus, many of the printing apparatuses first turn off a backlight of an operation unit and then gradually turn off a scanner and a printer therein. When the printing apparatuses receive a print job from a network during the sleep mode, the printing apparatuses do not energize the backlight of the operation unit or the scanner, but energize only the printer to perform printing.

However, when the print job received during the sleep mode specifies sheet feeding from a manual feed tray, even if a sheet is placed on the manual feed tray during the sleep mode, the backlight of the operation unit remains off. In this state, a setting for the sheet cannot be made, and printing cannot be performed unless the sleep mode is cancelled. Further, once the sleep mode is cancelled, the printing apparatuses can reenter the sleep mode only after a timer has counted a predetermined time, leading to a waste of power consumption.

SUMMARY OF THE INVENTION

According to an aspect of the present invention, a printing apparatus includes a power control unit configured to control power supply to an operation unit, an engine unit, and a controller unit, a detecting unit configured to detect a size of a sheet held in a sheet holding unit, and a determining unit configured to determine, after the printing apparatus is shifted to a power saving state which restricts power supply to the operation unit, the engine unit, and the controller unit, whether a size of a sheet specified in a received job and the detected size of the sheet match each other, wherein, in a case where the determining unit determines that the detected size and the specified size of the sheets match each other, the power control unit assists the printing apparatus to perform printing based on the received job by supplying power to the controller unit and the engine unit while maintaining the restriction on power supply to the operation unit, and shifts the printing apparatus to the power saving state after the job ends.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

<Description of a System Configuration>

Figure 1:
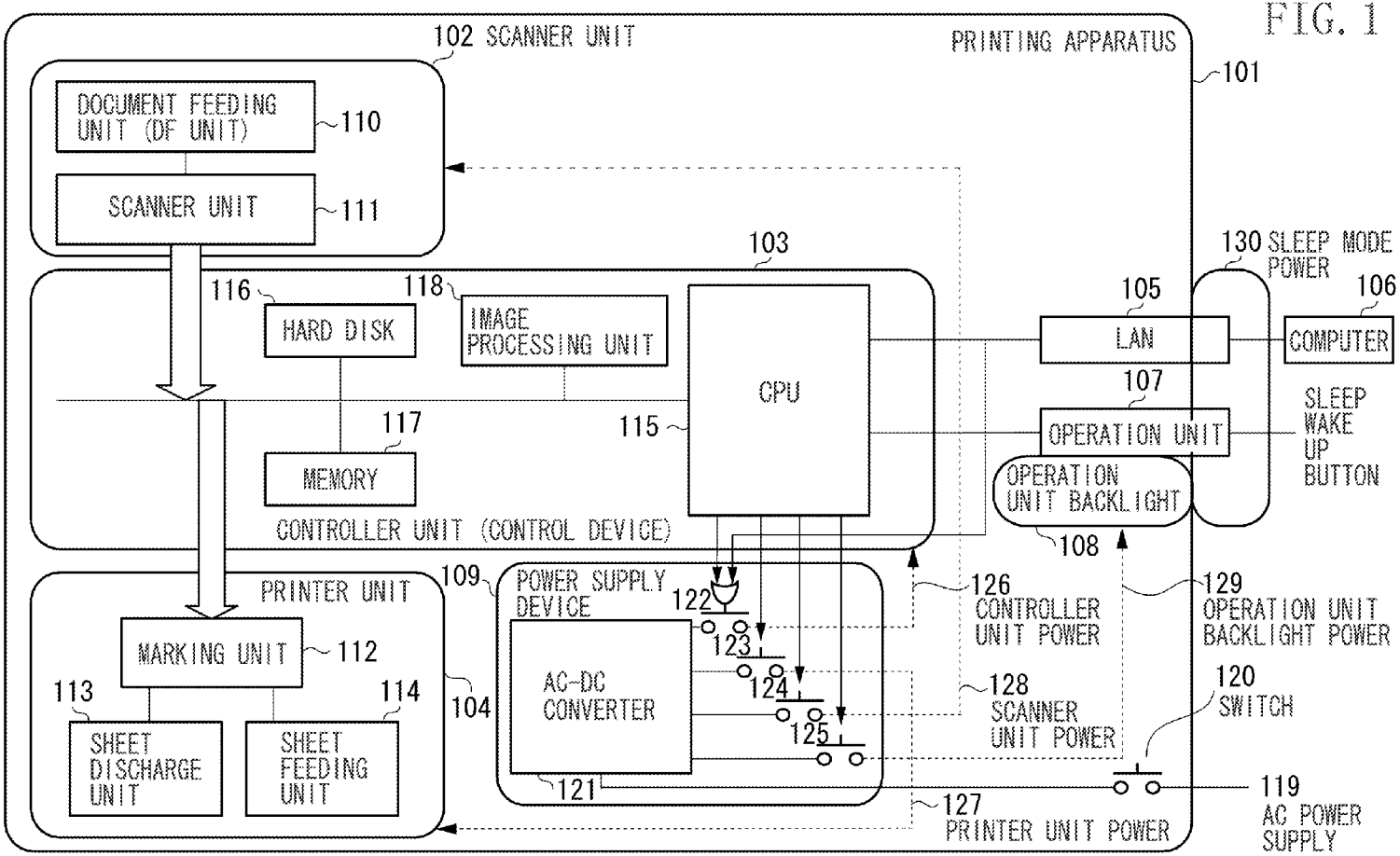
FIG. 1 is a block diagram illustrating a hardware configuration of a printing apparatus according to an exemplary embodiment of the present invention.

FIG. 1 is a block diagram illustrating a hardware configuration of a printing apparatus according to an exemplary embodiment of the present invention. In the present exemplary embodiment, a printing apparatus that performs job processing is used as an example. A printing apparatus according to the present exemplary embodiment includes an operation unit, an engine unit, and a controller unit, and as described later, performs power control for controlling power supply to the operation unit, the engine unit, and the controller unit in order to shift to a power saving state which has less power consumption than a normal state or to shift from the power saving state to the normal state.

In FIG. 1, a scanner unit 102 optically reads an image from a document, and converts the read image into a digital image. A controller unit 103 includes a central processing unit (CPU) 115, which controls a printer unit 104 by executing a control program to be loaded into a memory 117, to output the digital image on a sheet. An operation unit 107 includes a display unit (display) for displaying a UI screen described later. A hard disk 116 stores a digital image and a control program. The operation unit 107 includes a sleep wake up button described later.

A printing apparatus 101 can print image data from a computer 106 via a local area network (LAN) 105. The scanner unit 102 includes a document feeding (DF) unit 110 capable of automatically and sequentially replacing a batch of sheets, and a scanner unit 111 capable of optically scanning a document and converting the scanned document into a digital image. The resultant image data is sent to the controller unit 103.

The printer unit 104 includes a sheet feeding unit 114 capable of sheets one by one from a batch of sheets, a marking unit 112 for printing the image data on a fed sheet, and a sheet discharge unit 113 for discharging a printed sheet.

The CPU 115 in the controller unit 103 receives the image data from the scanner unit 102 and transmits the image data to the printer unit 104. The CPU 115 also stores the image data. More specifically, the controller unit 103 temporarily stores the image data, which has been received from the scanner unit 102, in the memory 117. Then, the image data is stored in the hard disk 116, so that scanning and storage of an image is completed.

The controller unit 103 can perform print output by temporarily storing the image data in the memory 117 from the hard disk 116 and then transmitting the image data from the memory 117 to the printer unit 104.

Further, the controller unit 103 includes an image processing unit 118 which performs processing (e.g., size reduction) of the image data stored in the memory 117, and stores the processed image data in the memory 117 again. The image processing unit 118 generates and processes the image data to be output to the printer unit 104.

A power supply device 109 supplies power in the printing apparatus 101. When the printing apparatus 101 is turned off, an alternating current (AC) power supply 119 is insulated using a switch 120. When the switch 120 is turned on, the AC power supply 119 is supplied to an alternating current-direct current (AC-DC) converter 121 to generate a DC power supply.

The power supply device 109 can control four independent power supply operations for the printing apparatus 101 in response to an instruction from the CPU 115. More specifically, a switch 122 connecting to the CPU 115 can perform off/on control of a controller unit power 126. Similarly, a switch 123, a switch 124, and a switch 125 can respectively perform off/on control of a printer unit power 127, a scanner unit power 128, and an operation unit backlight power 129.

The CPU 115 uses the switches 122 to 125 to properly supply power to the required places in the printing apparatus 101. In a situation where the printing apparatus 101 is not in operation, the CPU 115 can turn off all the switches 122 to 125. In this situation, only a sleep mode power 130 is energized so that a print job from the computer 106 and a press of a sleep wake up button provided in the operation unit 107 can be detected.

When a print job or a press of the sleep wake up button is detected, the controller unit power 126 is turned on hardware-wise. The CPU 115 turns on the switches 122 to 125 according to the situation.

Figure 2:
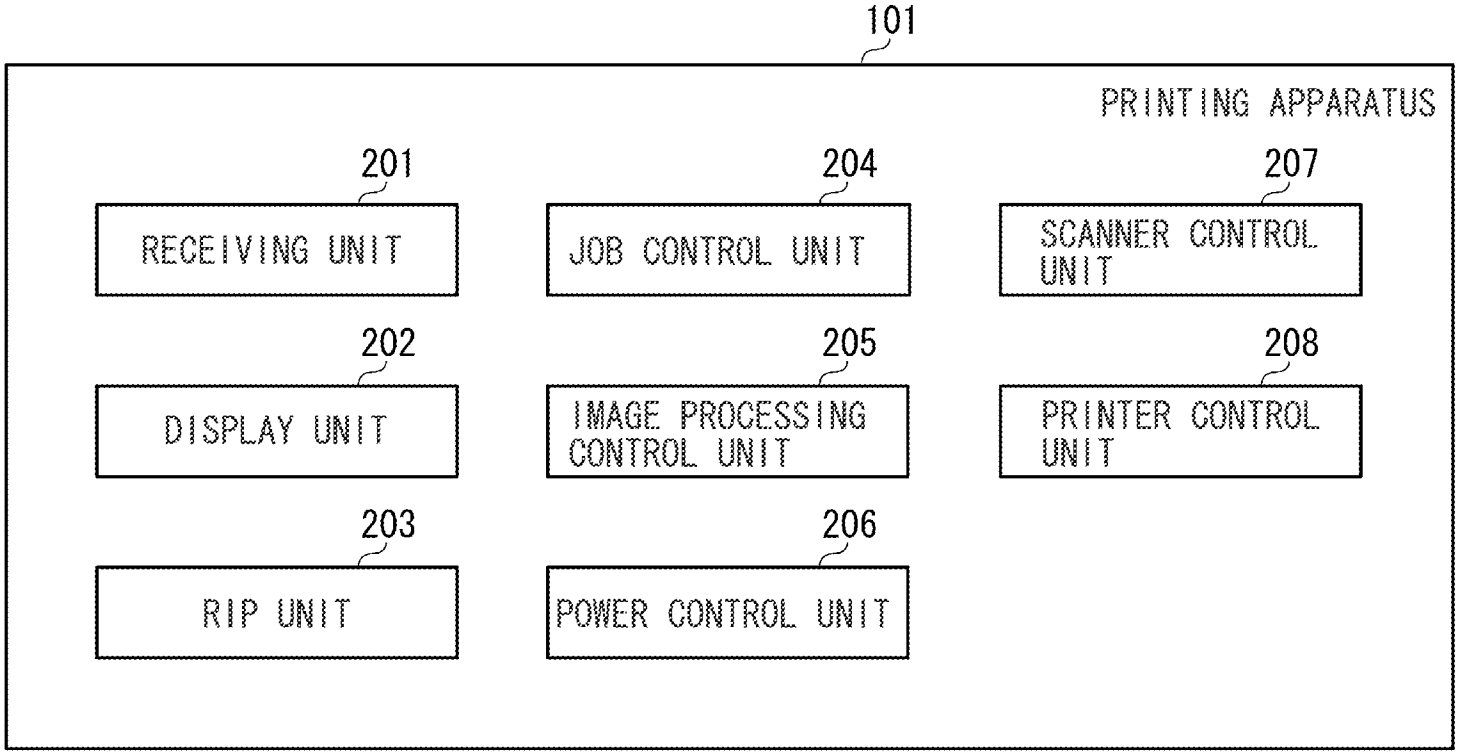
FIG. 2 is a block diagram illustrating a configuration of program modules in the printing apparatus illustrated in FIG. 1.

FIG. 2 is a block diagram illustrating a configuration of program modules 201 to 208 in the printing apparatus 101 according to the present exemplary embodiment illustrated in FIG. 1. The program modules 201 to 208 in the printing apparatus 101 are stored in the hard disk 116, loaded into the memory 117, and then executed.

In FIG. 2, a job control unit 204 manages a print job from the computer 106 and a copy job from the scanner unit 102, which have been received by a receiving unit 201 via the LAN 105. The job control unit 204 controls a raster image processor (RIP) unit 203, an image processing control unit 205, a scanner control unit 207, and a printer control unit 208, to execute the jobs.

A display unit 202 displays a job status on the operation unit 107. The RIP unit 203 converts a page description language (PDL) of the print job from the computer 106 into raster image data. The image processing control unit 205 uses the image processing unit 118 to perform image processing such as zooming, rotation, color conversion, and smoothing.

A power control unit 206 controls off/on of the switches 122 to 125 to perform optimum power control of the printing apparatus 101. The scanner control unit 207 controls the scanner unit 102 to scan a document and generate image data. The printer control unit 208 controls the printer unit 104 to print the image data.

Figure 3:
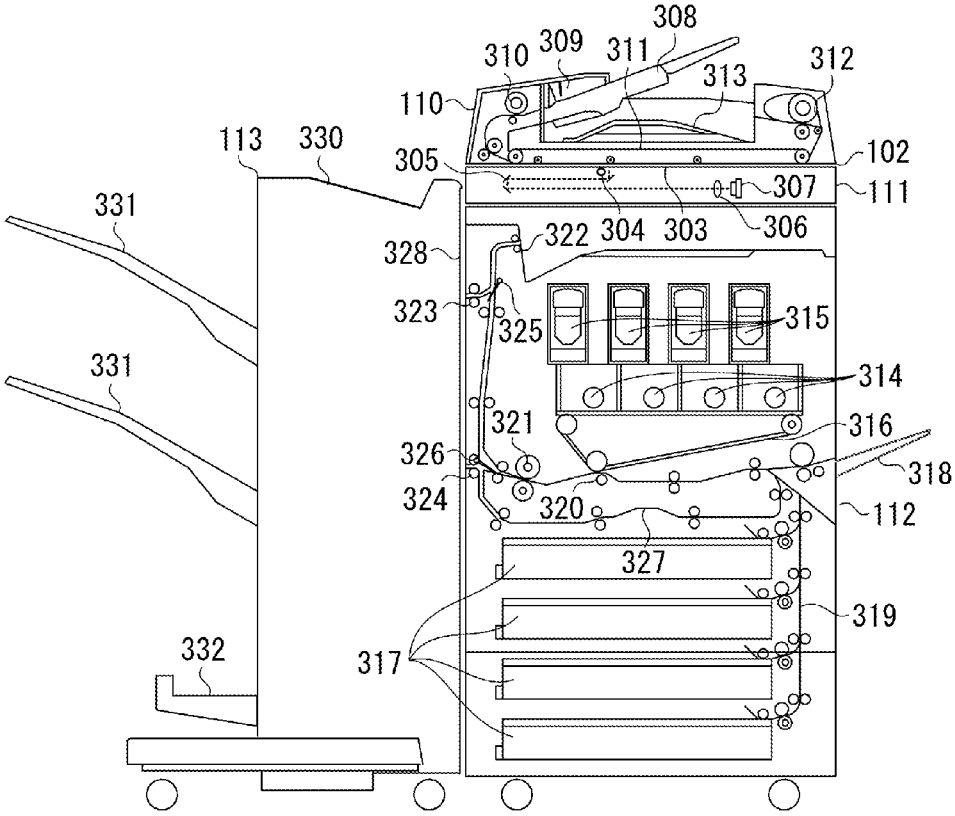
FIG. 3 is a cross-sectional view illustrating an example of the printing apparatus according to the present exemplary embodiment.

FIG. 3 is a cross-sectional view illustrating an example of the printing apparatus 101 according to the present exemplary embodiment. The printing apparatus 101 illustrated in this example includes the scanner unit 102 and the printer unit 104.

In FIG. 3, the scanner unit 102 including the scanner unit 111 and the document feeding (DF) unit 110 is used to optically read a document. When a document is placed on a document platen 303 for reading, the document feeding unit 110 is closed after the document is placed thereon.

When the reading is started, the document is irradiated with a light source 304. A charge coupled device (CCD) 307 reads an image via a reflection plate 305 and a lens 306, and converts the read image into a digital signal. The digital signal is converted into print image data by being subjected to desired image processing. The resultant print image data is stored in the hard disk 116.

When a document is placed on the document feeding unit 110 for reading, the document is positioned on a tray of a document set unit 308 in the document feeding unit 110. When the reading is started, a document presence/absence sensor 309 detects setting of the document. A sheet feeding roller 310 and a conveyance belt 311 rotate to convey the document in response to the detection, to place the document at a predetermined position on the document platen 303. After that, the image is read, like when the document is placed on the document platen 303 for reading, and is stored in the hard disk 116.

When the reading is completed, the conveyance belt 311 rotates again to feed the document. The document is discharged into a document discharge tray 313 via a conveyance roller 312 on the discharge side. If a plurality of documents exists, at the same time that a document is discharged and conveyed from the document platen 303, the next document is fed via the sheet feeding roller 310. Thus, the subsequent documents are continuously read.

The printer unit 104 is used to print the print image data stored in the hard disk 116. The print image data is irradiated as recording laser beams in four colors, i.e., yellow, magenta, cyan, and black, on respective photosensitive members 314, so that electrostatic latent images are formed on the photosensitive members 314. Then, toner development is performed using toner supplied from each of toner cartridges 315. A visualized image is primarily transferred onto an intermediate transfer belt 316.

Figure 4:
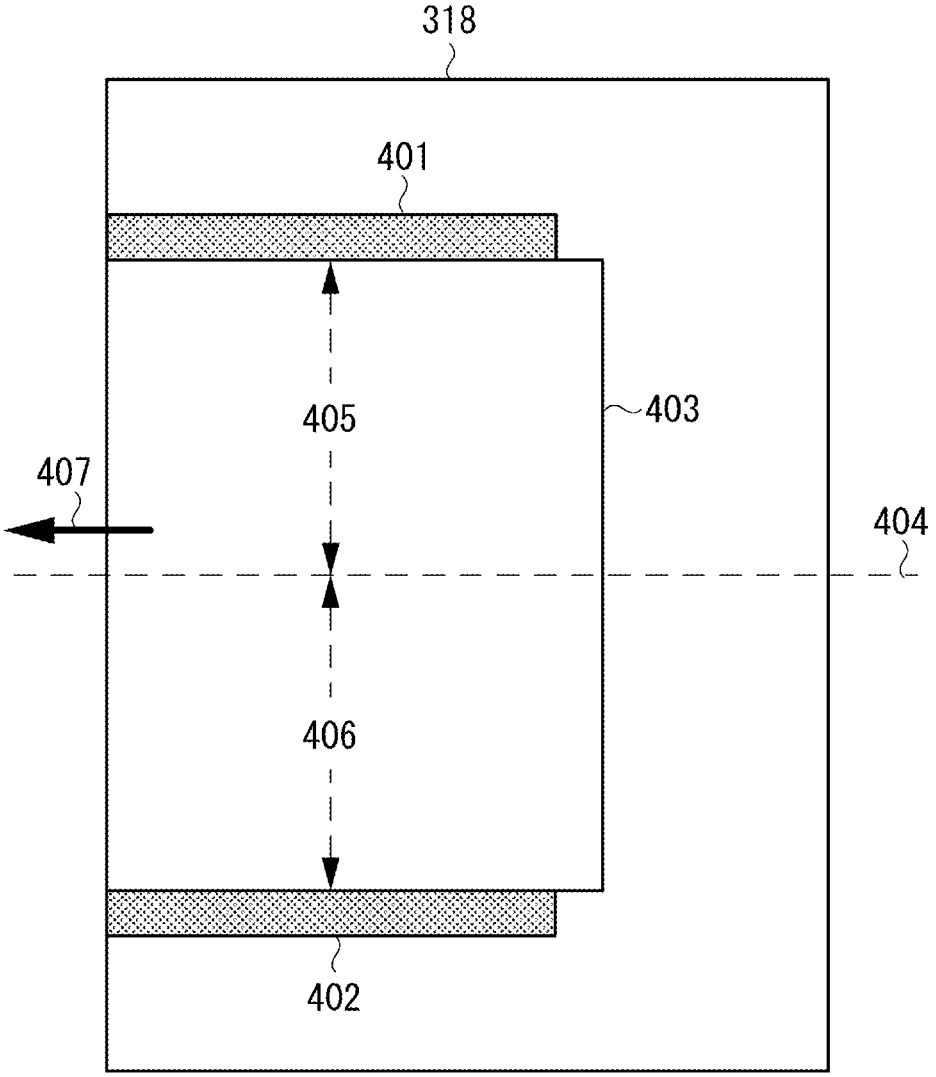
FIG. 4 is a plan view of a manual feed tray illustrated in FIG. 3.

The intermediate transfer belt 316 rotates in a clockwise direction, and a recording sheet, which has been fed from the sheet feeding unit 114 (paper cassettes 317 or a manual feed tray 318) via a sheet feeding conveyance path 319, is conveyed to a secondary transfer position 320. More specifically, the image is transferred onto the recording sheet from the intermediate transfer belt 316 at the secondary transfer position 320. The manual feed tray 318 is provided as a manual sheet feeding unit. As illustrated in FIG. 4, the manual feed tray 318 includes a plurality of sensors, and can detect the width of a sheet to be manually fed and the presence or absence of the sheet.

A fixing device 321 fixes the toner onto the recording sheet, on which the image has been transferred, by pressurization and heat. The recording sheet is then conveyed on a sheet discharge conveyance path. The conveyed recording sheet is then discharged to a center tray discharge port 322, is discharged to a sheet discharge port 323 for the sheet discharge unit 113 by switching back, or is discharged to a side tray discharge port 324. However, the side tray discharge port 324 is a discharge port to which the recording sheet can be discharged only if a post-processing unit is not mounted. Flappers 325 and 326 switch the sheet discharge conveyance path to switch the discharge ports.

In the case of two-sided printing, after the recording sheet passes through the fixing unit 321, the flapper 326 switches the conveyance path to allow the recording sheet to be switched back, fed downward, and then conveyed to the secondary transfer position 320 again via a two-sided printing sheet conveyance path 327.

The sheet discharge unit 113 is used to apply post-processing to the printed recording sheet according to a function specified by a user. The printed recording sheet, which has been conveyed from the sheet discharge port 323 for the sheet discharge unit 113, is fed from a post-processing unit feed port 328.

The sheet, which has been fed from the post-processing unit feed port 328, is conveyed to any one of sheet discharge destinations 330, 331, and 332 by a flapper (not illustrated) switching to the corresponding conveyance path. If the sheet is discharged to the sheet discharge destination 330, there is no special post-processing to be performed. Thus, the sheet is directly discharged. If the sheet is output to the sheet discharge destination 331, staple processing or processing for shifting to the back/front of the printing apparatus 101 are performed. The sheet is discharged to the sheet discharge destination 332 in the case of saddle-stitch output.

FIG. 4 is a plan view of the manual feed tray 318 illustrated in FIG. 3.

In FIG. 4, various sizes of sheets including not only a standard-size sheet but also an envelope and a postcard can be fed from the manual feed tray 318. Further, various types of sheets can be fed because a sheet conveyance path is straight.

In FIG. 4, guides 401 and 402 move in synchronization with each other, around a center line 404 of the manual feed tray 318. In the example illustrated in FIG. 4, the guides 401 and 402 move in the upward/downward direction.

Since the guides 401 and 402 move in synchronization with each other, respective lengths 405 and 406 from the center line 404 to the guides 401 and 402 are always the same.

The guides 401 and 402 operate in synchronization with a sensor (not illustrated), and when a sheet 403 is held between the guides 401 and 402, the main scanning width of the sheet 403 can be detected. The sheet 403 is fed from the manual feed tray 318 in a sheet feeding direction 407.

Further, the manual feed tray 318 has a manual feed sheet detection sensor (not illustrated) which can detect that the sheet 403 has been placed on the manual feed tray 318. The manual feed sheet detection sensor can perform the detection only when the printer unit 104 is energized, and thus operates only when the switch 123 is turned on so that the printer unit power 127 is turned on.

Figure 5:
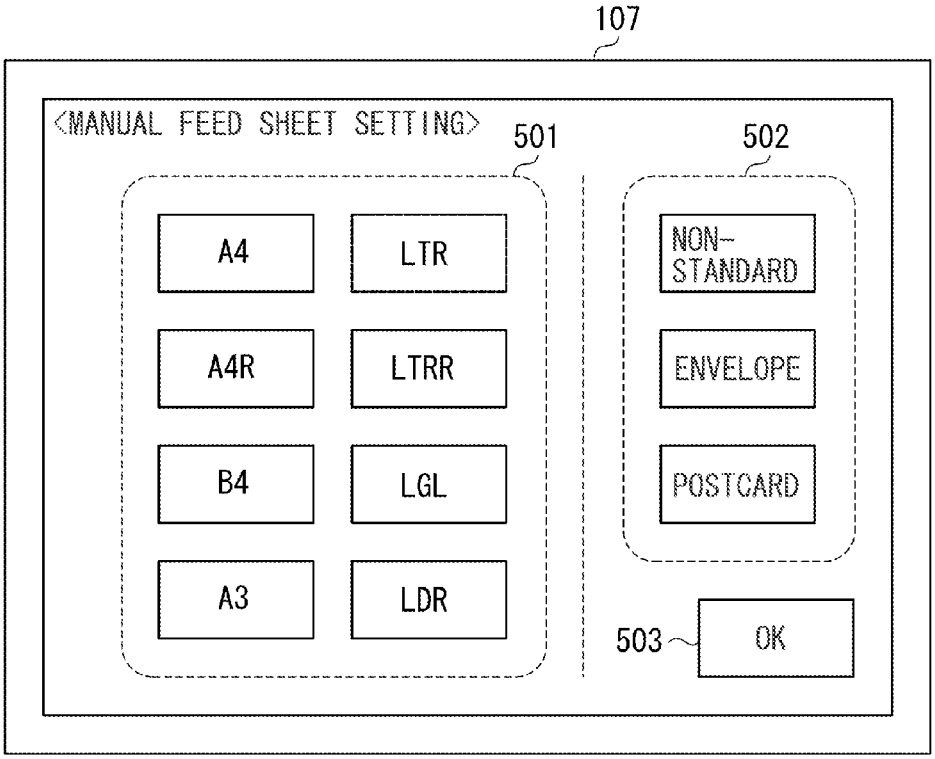
FIG. 5 illustrates an example of a user interface (UI) screen displayed on a display unit of an operation unit illustrated in FIG. 1.

FIG. 5 illustrates an example of a UI screen displayed on the display unit of the operation unit 107 illustrated in FIG. 1. A manual feed sheet setting screen is used as an example of the UI screen. The manual feed sheet setting screen is displayed on the operation unit 107 when the sensor detects that a sheet is placed on the manual feed tray 318.

In FIG. 5, the size of the sheet placed on the manual feed tray 318 can be set to a standard size by pressing any one of standard sheet size selection keys 501. Non-standard sheet size selection keys 502 are used to select a sheet size other than the standard size, specifically, a non-standard size, an envelope size, or a postcard size.

When one of the non-standard sheet size selection keys 501 is pressed, the manual feed sheet setting screen shifts to the detail setting screen (not illustrated) for each non-standard sheet size, so that the setting can be made in more detail. An OK key 503 is a key for confirming the setting made on the manual feed sheet setting screen illustrated in FIG. 5 and then exiting from the manual feed sheet setting screen. The printer unit 104 is notified of the manual feed sheet size at the timing when the OK key 503 has been pressed, and the size of the sheet placed on the manual feed tray 318 is determined.

Generally, the size of the sheet placed on the manual feed tray 318 cannot be determined unless the manual feed sheet setting is made on the manual feed sheet setting screen illustrated in FIG. 5. Thus, the job control unit 204 does not feed the sheet from the manual feed tray 318 until the size of the sheet is determined.

Figure 6:
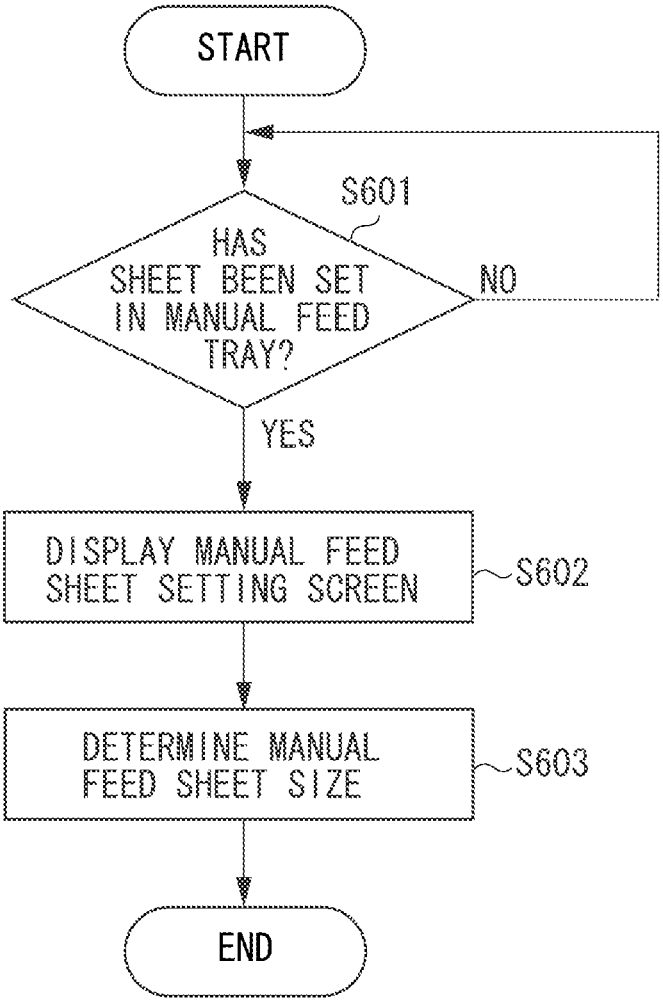
FIG. 6 is a flowchart illustrating a method for controlling the printing apparatus.

FIG. 6 is a flowchart illustrating a method for controlling the printing apparatus 101 according to the present exemplary embodiment. This is an example of manual feed sheet setting processing. Steps S601 to S603 illustrated in FIG. 6 represent each step of the processing. A program for the printing apparatus 101 related to the flowchart is stored in the hard disk 116, loaded into the memory 117, and then executed by the CPU 115.

In step S601, the CPU 115 detects whether a sheet has been placed on the manual feed tray 318. If the CPU 115 detects that the sheet has been placed on the manual feed tray 318 (YES in step S601), then in step S602, the CPU 115 displays the manual feed sheet setting screen illustrated in FIG. 5 on the display unit of the operation unit 107. In step S603, the CPU 115 notifies the printer unit 104 of information selected by the user on the manual feed sheet setting screen illustrated in FIG. 5 at the timing when the OK key 503 has been pressed, so that the size of the sheet on the manual feed tray 318 is determined.

Figure 7A:
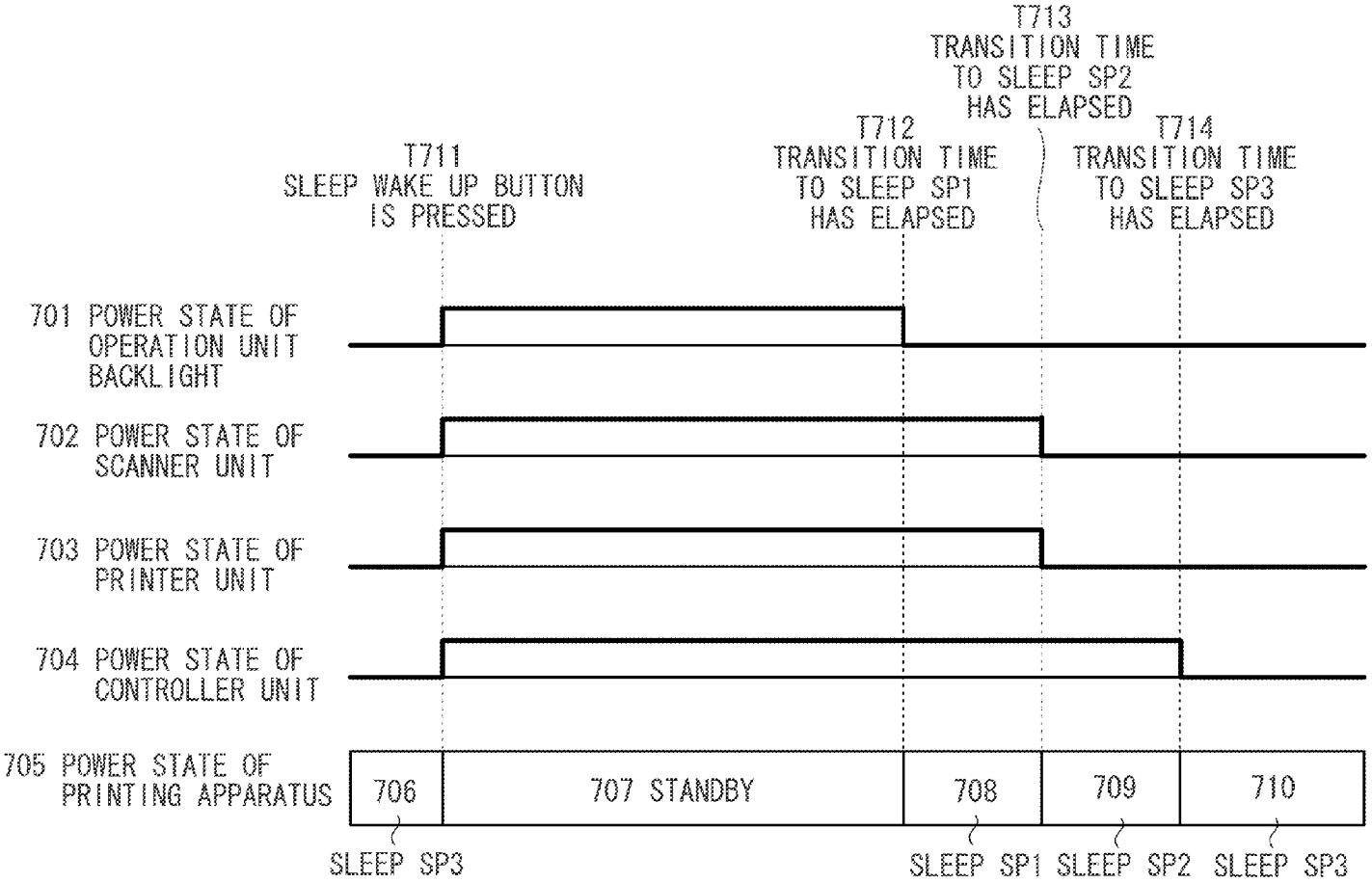
FIGS. 7A and 7B are timing charts illustrating a method for controlling the printing apparatus.
Figure 7B:
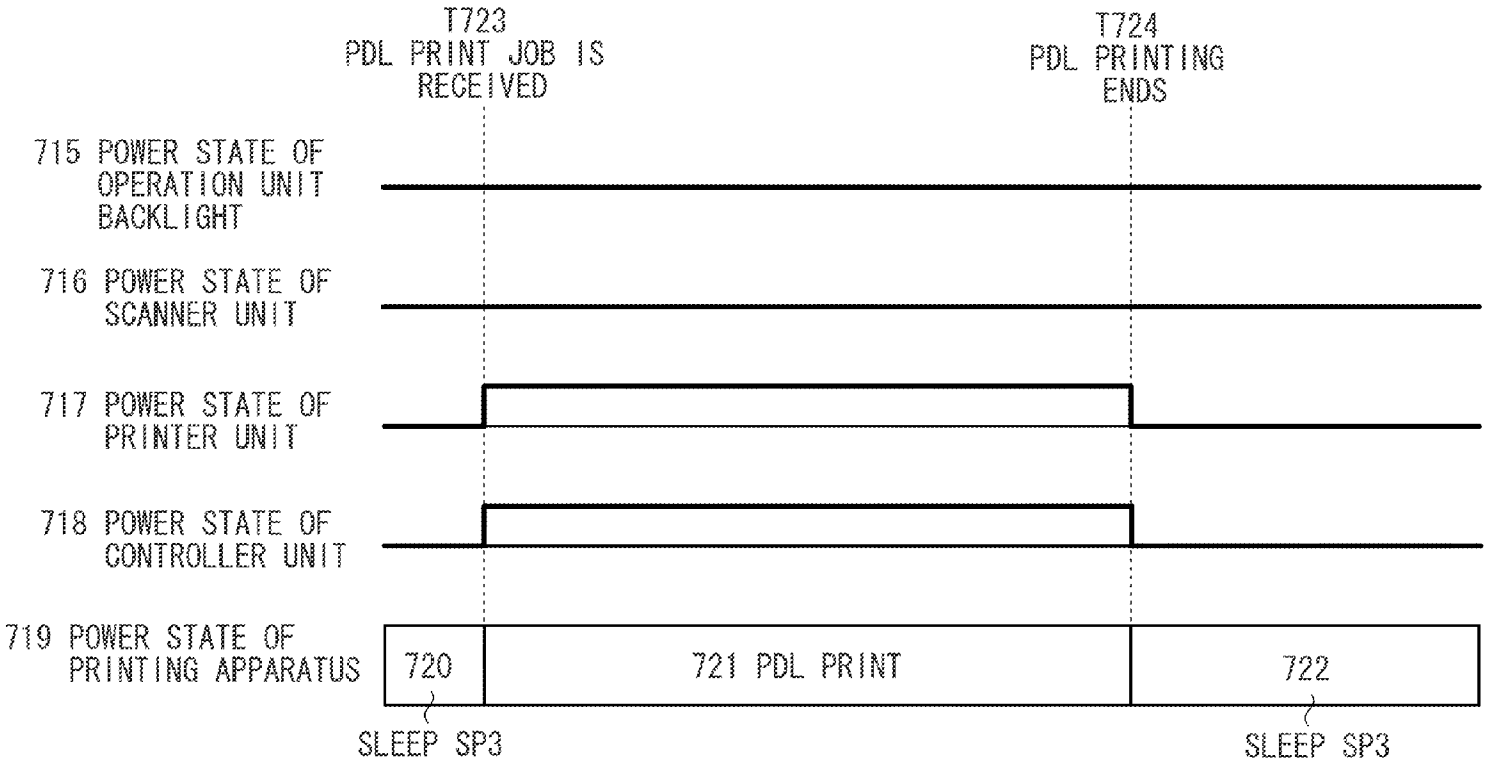

FIGS. 7A and 7B are timing charts illustrating methods for controlling the printing apparatus 101 according to the present exemplary embodiment. In this example, the timing charts show the transition of the printing apparatus 101 from a normal state to a sleep state which has less power consumption than the normal state.

FIG. 7A is a timing chart illustrating the transition of the printing apparatus 101 to a sleep state. In the present exemplary embodiment, "sleep" represents a state where power to some or all of the scanner unit 102, the controller unit 103, the printer unit 104, and the operation unit backlight 108 are turned off.

FIG. 7A illustrates a power state 701 of the operation unit backlight 108, a power state 702 of the scanner unit 102, a power state 703 of the printer unit 104, a power state 704 of the controller unit 103, and a power state 705 of the printing apparatus 101.

In the present exemplary embodiment, "sleep" includes three levels, sleeps SP1 to SP3 described below.

[Sleep SP1]

The sleep SP1 represents a state where only the operation unit backlight power 129 is turned off, and the controller unit power 126, the printer unit power 127, and the scanner unit power 128 are turned on.

[Sleep SP2]

The sleep SP2 represents a state where the operation unit backlight power 129, the printer unit power 127, and the scanner unit power 128 are turned off, and the controller unit power 126 is turned on.

[Sleep SP3]

The sleep SP3 represents a state where all the operation unit backlight power 129, the controller unit power 126, the printer unit power 127, and the scanner unit power 128 are turned off.

In FIG. 7A, the power state 705 of the printing apparatus 101 is a power state 706 (a sleep SP3) until the sleep wake up button is pressed at timing T711.

When the sleep wake up button is pressed at timing T711, all the powers 126 to 129 are turned on, and the power state 705 of the printing apparatus 101 becomes a standby state 707. After the printing apparatus 101 has entered the standby state 707, the CPU 115 turns off the switch 125 at timing T712 when a predetermined time has elapsed since the operation unit 107 was last touched. Thus, the power state 705 of the printing apparatus 101 is shifted to a power state 708 (a sleep SP1).

If the sleep wake up button is not pressed for another predetermined time, the CPU 115 turns off the switch 123 and the switch 124 at timing T713, so that the power state 705 is shifted to a power state 709 (a sleep SP2). Further, if the sleep wake up button is not pressed for another predetermined time, the CPU 115 turns off the switch 122 at timing T714, so that the power state 705 is shifted to a power state 710 (a sleep SP3). Thus, in order for the power state 705 of the printing apparatus 101 to shift from the standby state 707 to the power state 710 (the sleep SP3), which has minimum power consumption, the printing apparatus 101 needs to sequentially shift from the sleep SP1 to the sleep SP3 under the condition where the operation unit 107 has not been touched for a predetermined time since the operation unit 107 was last touched. A time elapsed until the printing apparatus 101 is shifted to each sleep state can be set from the operation unit 107, and is stored in the hard disk 116.

Thus, in the present exemplary embodiment, after an instruction for cancelling the power saving state is received (the sleep wake up button is turned on), the CPU 115 gradually stops supplying power to the operation unit 107, the engine unit (the printer unit 104), and the controller unit 103 to change the sleep state with a lapse of time.

FIG. 7B is a timing chart illustrating a state transition when a PDL print job is received while a power state 719 of the printing apparatus 101 is a power state 720 (a sleep SP3).

In the present exemplary embodiment, if the CPU 115 receives a PDL print job while the power state 719 of the printing apparatus 101 is the power state 720 (the sleep SP3), only the controller unit power 126 and the printer unit power 127 required for printing are turned on (see power states 718 and 717).

It can be assumed that no user exists in front of the printing apparatus 101 if the sleep wake up button is not pressed during printing. Thus, the power state 719 of the printing apparatus 101 is immediately shifted to a power state 722 (a sleep SP3) after the printing is completed.

FIG. 7B illustrates a power state 715 of the operation unit backlight 108, a power state 716 of the scanner unit 102, the power state 717 of the printer unit 104, the power state 718 of the controller unit 103, and the power state 719 of the printing apparatus 101.

In FIG. 7B, the power state 719 of the printing apparatus 101 is the power state 720 (the sleep SP3) until a PDL print job is received at timing T723. When a PDL print job is received at timing T723, the controller unit power 126 is turned on hardware-wise. The CPU 115 detects that the PDL print job has been received, and turns on the switch 123 to turn on the printer unit power 127.

Then, the CPU 115 starts printing, and the printing apparatus 101 enters a PDL print state 721. When the printing ends at timing T724, the CPU 115 determines that the sleep wake up button is not pressed and the sleep state is maintained, and then turns off the controller unit power 126 and the printer unit power 127. Thus, the power state 719 of the printing apparatus 101 is shifted to a power state 722 (a sleep SP3).

Thus, in the present exemplary embodiment, when a PDL print job is received during the sleep SP3, the controller unit power 126 and the printer unit power 127 are turned on only during the printing, and are turned off after the printing, so that power efficiency is increased.

Figure 8:
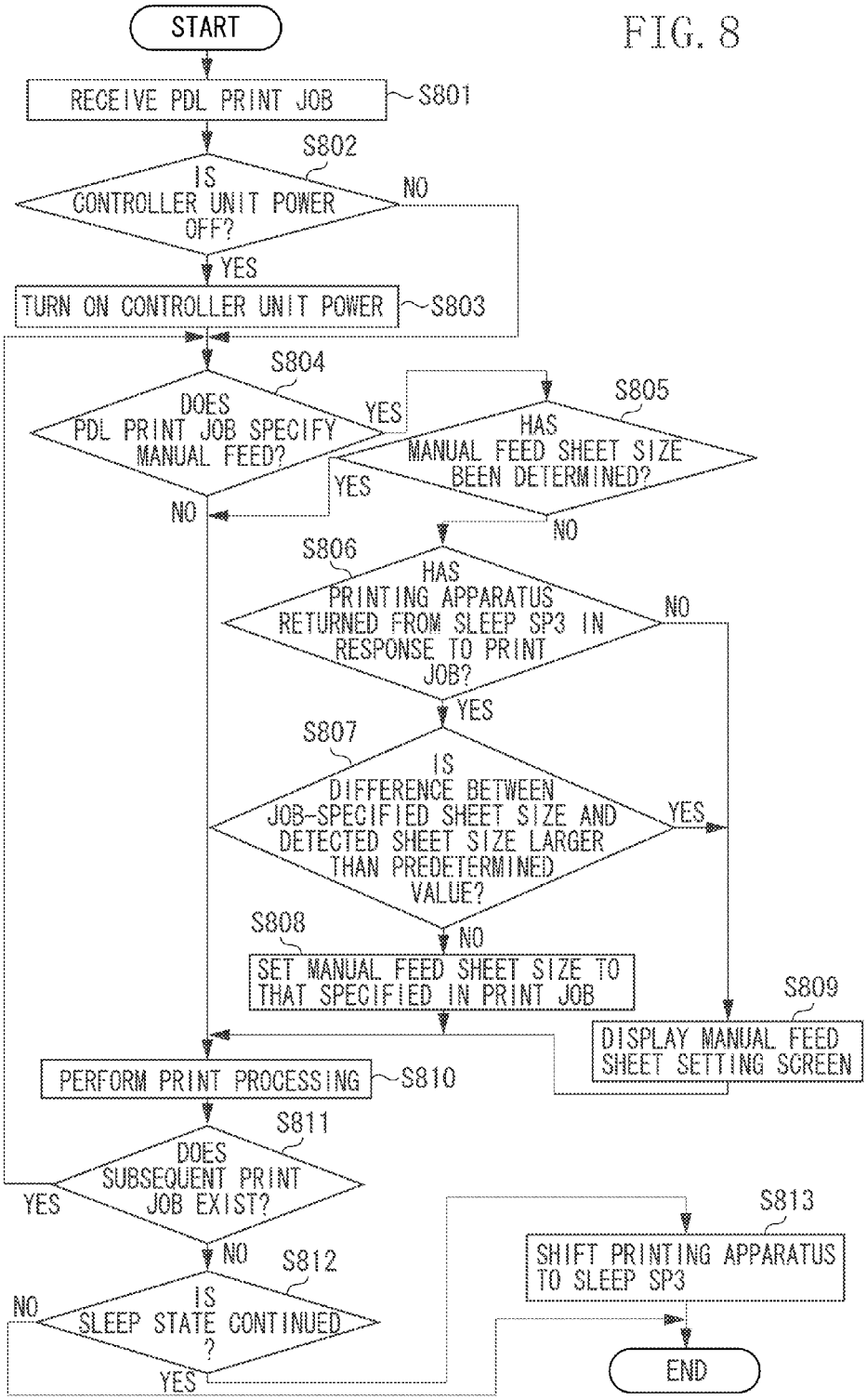
FIG. 8 is a flowchart illustrating a method for controlling the printing apparatus.

FIG. 8 is a flowchart illustrating a method for controlling the printing apparatus 101 according to the present exemplary embodiment. This is an example of processing of a print job that specifies manual feed. Steps S801 to S812 illustrated in FIG. 8 represent each step of the processing. A program for the printing apparatus 101 related to the flowchart is stored in the hard disk 116, loaded into the memory 117, and then executed by the CPU 115. Power control, which is performed when a job that specifies manual sheet feeding is received after the power state 719 of the printing apparatus 101 is shifted to a power saving state and when a sheet size specified in the job and a detected sheet size match each other, will be described below.

In step S801, a PDL print job is received from the computer 106 via the LAN 105. In step S802, whether the controller unit power 126 is turned off is determined. If the controller unit power 126 is turned on (NO in step S802), the processing proceeds to step S804. If the controller unit power 126 is turned off (YES in step S802), the printing apparatus 101 is in the sleep SP3, and the processing proceeds to step S803. In step S803, the switch 122 is turned on hardware-wise based on an instruction from the LAN 105 to turn on the controller unit power 126.

When the controller unit power 126 has been turned on, the CPU 115 determines that a PDL print job has been received, and turns on the switch 123 for turning on the printer unit power 127 to perform printing, and the processing proceeds to step S804. At this time, the CPU 115 does not turn on the operation unit backlight power 129 to maintain the sleep state of the operation unit 107.

In step S804, the CPU 115 determines based on setting information whether the received PDL print job specifies manual feed. If the received PDL print job specifies manual feed (YES in step S804), the processing proceeds to step S805. If the received PDL print job does not specify manual feed (NO in step S804), the processing proceeds to step S810.

In step S805, the CPU 115 determines whether the size of the sheet on the manual feed tray 318 has been determined. If the CPU determines that the size of the sheet on the manual feed tray 318 has been determined according to the flowchart illustrated in FIG. 6 or that no sheet exists on the manual feed tray 318 (YES in step S805), the processing proceeds to step S810. On the other hand, if the CPU 115 determines that the sheet exists on the manual feed tray 318 but the size thereof has not been determined (NO in step S805), the processing proceeds to step S806.

In step S806, the CPU 115 determines whether the printing apparatus 101 has returned from the sleep SP3 in response to the PDL print job for which printing is about to be performed. If the CPU 115 determines that the printing apparatus 101 has returned from the sleep SP3 in response to the PDL print job (YES in step S806), the processing proceeds to step S807. Otherwise (NO in step S806), the processing proceeds to step 5809.

In step S807, the CPU 115 compares sheet information, which has been specified in the PDL print job, with the main scanning width of the sheet, which has been detected in FIG. 4, in order to determine whether a difference between the size of a sheet specified in the PDL print job and the size of the detected sheet is larger than a predetermined value (threshold value). If the CPU 115 determines that the difference is larger than the predetermined value (YES in step S807), the processing proceeds to step S809. If the CPU 115 determines that the difference is smaller than the predetermined value (NO in step S807), the processing proceeds to step S808.

In step S808, the CPU 115 notifies the printer unit 104 of the sheet information, which has been specified in the PDL print job, to set the size of the sheet on the manual feed tray 318 to that specified in the PDL print job. This flow allows the CPU 115 to determine the size of the sheet on the manual feed tray 318 without the user performing the operation in the flowchart illustrated in FIG. 6, and to perform printing for the PDL print job while maintaining the sleep state of the operation unit 107. More specifically, this control method can keep a screen display of the operation unit 107 in off state.

On the other hand, in step S809, the CPU 115 stops the printing, turns on the operation unit backlight power 129, displays the manual feed sheet setting screen illustrated in FIG. 5 on the operation unit 107, and prompts the user to perform the operation in the flowchart illustrated in FIG. 6.

In step S810, the CPU 115 performs print processing, and the processing proceeds to step S811. If the CPU 115 has determined that no sheet is placed on the manual feed tray 318 (NO in step S805), then in step S810, the CPU 115 determines that there is no sheet. Although not described in the flowchart illustrated in FIG. 8, at this point, if the user places a sheet on the manual feed tray 318, the CPU 115 may go through the flow in steps S804 to S808 again so that the CPU 115 can perform printing without the user performing manual feed sheet setting on the operation unit 107.

Further, even if the CPU 115 determines that the difference is more than the predetermined value (threshold value) in step S807, and the processing proceeds to step S809, if a sheet is placed on the manual feed tray 318 again, the CPU 115 goes through the flow in steps S804 to S808 again. Thus, the CPU 115 can perform printing without the user performing manual feed sheet setting on the operation unit 107. In other words, the printing apparatus 101 may be controlled to start processing of a PDL print job according to a sheet size to be detected again, if the CPU 115 determines that the sheet sizes do not match each other.

In step S811, the CPU 115 determines whether the subsequent print job exists. If the CPU 115 determines that the subsequent print job exists (YES in step S811), the processing returns to step S804. If the CPU 115 determines that the subsequent print job does not exist (NO in step S811), the processing proceeds to step S812.

In step S812, the CPU 115 determines whether the sleep state where the operation unit backlight power 129 and the scanner unit power 128 are turned off is continued because the sleep wake up button is not pressed. If the CPU 115 determines that the sleep state is continued (YES in step S812), the processing proceeds to step S813. Otherwise (NO in step S812), the processing ends.

In step S813, the CPU 115 turns off the switches 122 and 123 to turn off the controller unit power 126 and the printer unit power 127, so that the power state 719 of the printing apparatus 101 is shifted to the power state 722 (the sleep SP3).

Figure 9A:
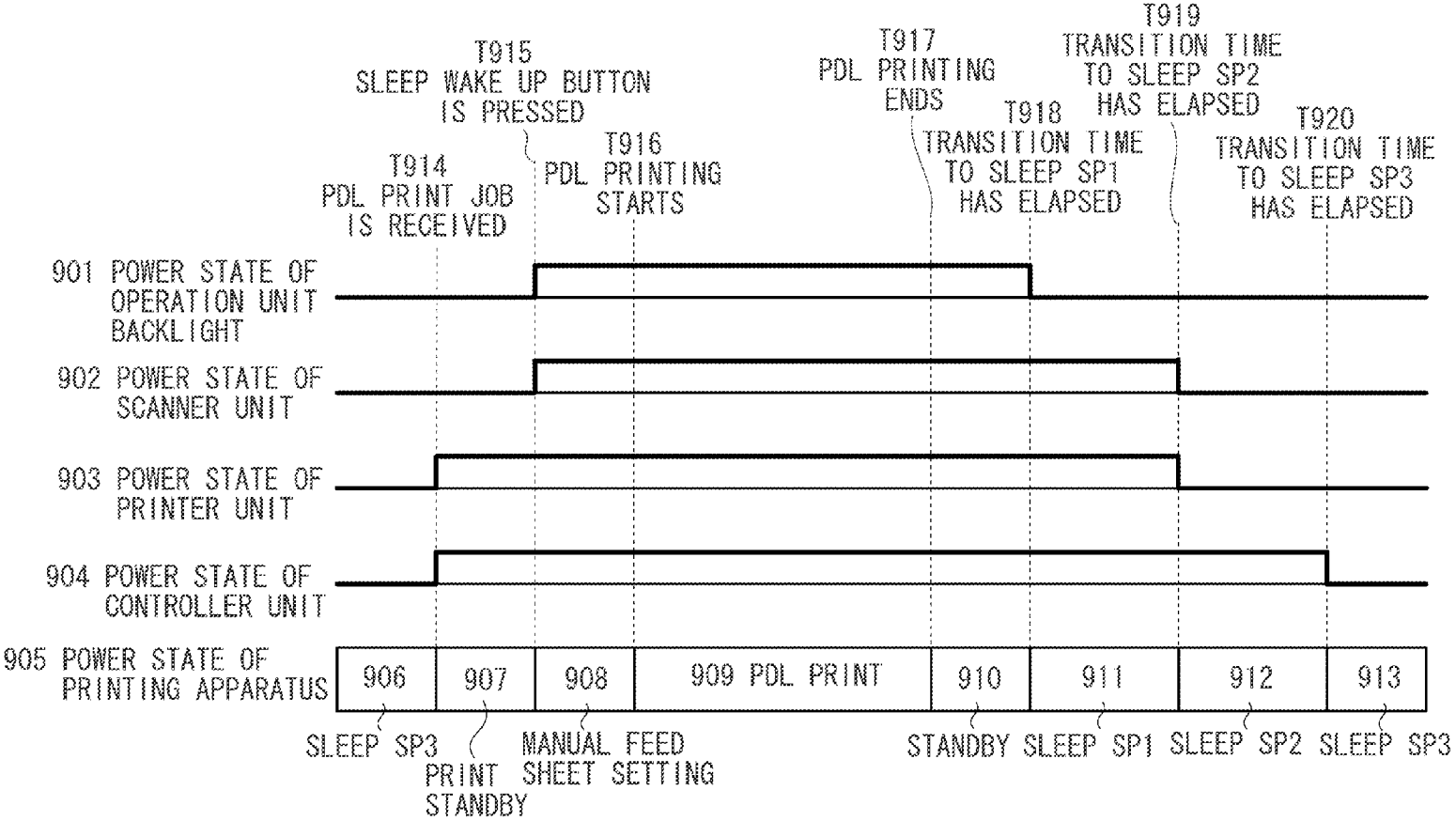
FIGS. 9A and 9B are timing charts illustrating a method for controlling the printing apparatus.
Figure 9B:
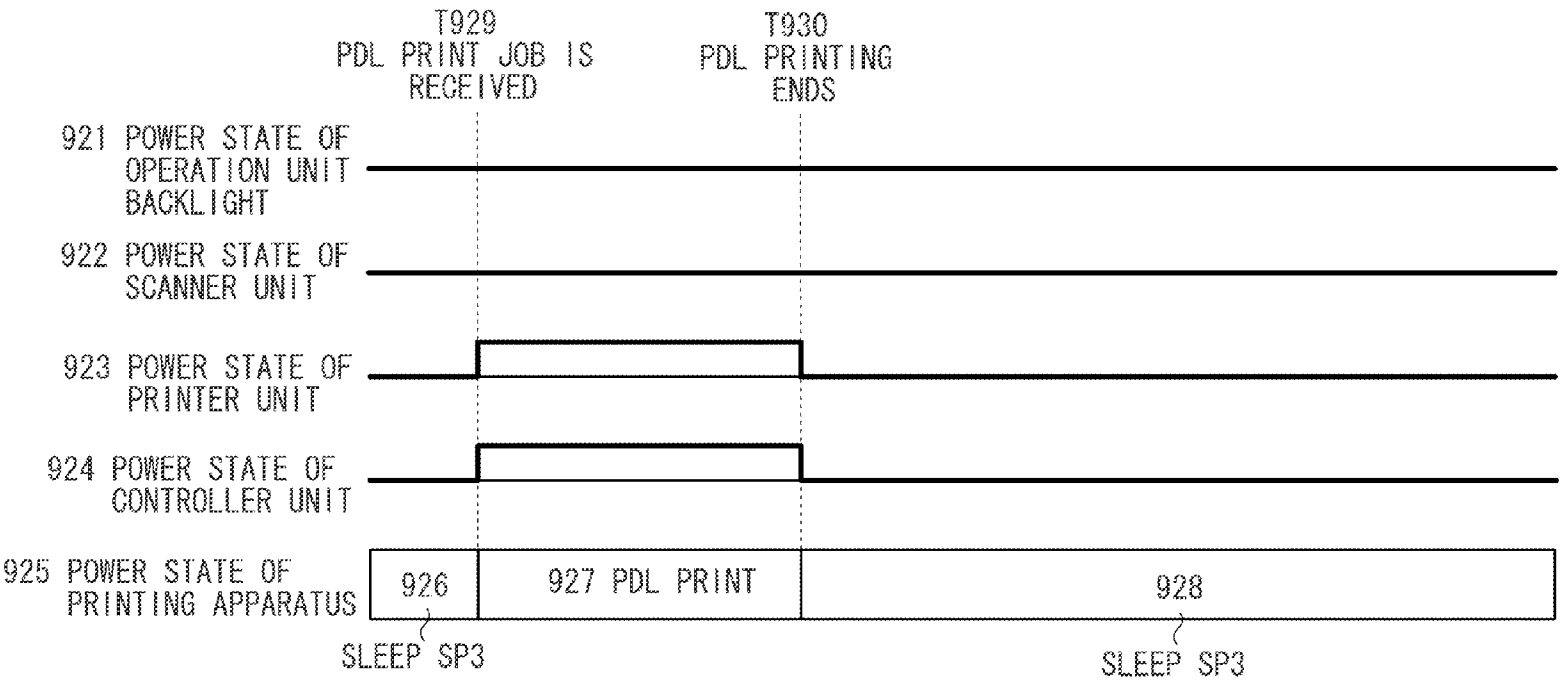

FIGS. 9A and 9B are timing charts illustrating methods for controlling the printing apparatus 101 according to the present exemplary embodiment. In this example, the timing charts illustrate a state transition when a print job that specifies manual feed is received while the printing apparatus 101 in a sleep mode.

FIG. 9A illustrates a state transition when a print job that specifies manual feed is received during a sleep mode, if the flowchart illustrated in FIG. 8 is not used.

FIG. 9A illustrates a power state 901 of the operation unit backlight 108, a power state 902 of the scanner unit 102, and a power state 905 of the printing apparatus 101.

When a PDL print job is received at timing T914 while the power state 905 of the printing apparatus 101 is a power state 906 (a sleep SP3), only the controller unit power 126 and the printer unit power 127 required for printing are turned on.

When the received PDL print job specifies manual feed, even if a sheet has been placed on the manual feed tray 318, the sheet cannot be fed from the manual feed tray 318 unless manual feed sheet setting is performed on the operation unit 107, and the printing apparatus 101 enters a print standby state 907. To start printing from this state, the user needs to press the sleep wake up button at timing T915 to cause the printing apparatus 101 to return from the sleep state so that the manual feed sheet setting can be performed on the operation unit 107 in a power state 908.

When the manual feed sheet setting is performed, the size of the sheet on the manual feed tray 318 is determined, and then printing is started at timing T916. Thus, the power state 905 of the printing apparatus 101 becomes a power state 909 (a PDL print state). When the user presses the sleep wake up button at timing T915, all the powers 126 to 129 are turned on. Therefore, even if the printing is completed at timing T917, the power state 905 of the printing apparatus 101 cannot be shifted to a sleep SP3, and the power state 905 of the printing apparatus 101 becomes a power state 910 (a standby state).

Then, like in FIG. 7A, when a predetermined time has elapsed since the operation unit 107 was last operated, the power state 905 of the printing apparatus 101 is shifted at timings T918, T919, and T920 as described below. Specifically, the power state 905 of the printing apparatus 101 is shifted to a power state 911 (a sleep SP1), a power state 912 (a sleep SP2), and a power state 913 (a sleep SP3) in this order.

FIG. 9B illustrates a state transition when a print job that specifies manual feed is received during a sleep mode, if the flowchart illustrated in FIG. 8 is used. FIG. 9B illustrates a power state 921 of the operation unit backlight 108, a power state 922 of the scanner unit 102, a power state 923 of the printer unit 104, a power state 924 of the controller unit 103, and a power state 925 of the printing apparatus 101.

When a PDL print job is received at timing T929 while the power state 925 of the printing apparatus 101 is a power state 926 (a sleep SP3), only the controller unit power 126 and the printer unit power 127 required for printing are turned on.

Here, even if the received PDL print job specifies manual feed and the size of the sheet placed on the manual feed tray 318 has not been determined, the processing in steps S806 to S808 illustrated in FIG. 8 allows printing to be started without the state transition illustrated in FIG. 9A.

Thus, when the printing is performed in a power state 927, and ends at timing T930, the CPU 115 turns off the switch 122 and the switch 123 to turn off the controller unit power 126 and the printer unit power 127, respectively, so that the power state 925 of the printing apparatus 101 is shifted to a power state 928 (a sleep SP3). In FIG. 9B, sleep efficiency is higher than that in FIG. 9A, and therefore the printing apparatus 101 can be operated with lower power consumption.

According to the present exemplary embodiment, when a print job received during a sleep mode requires use of a manual feed tray, even if the size of a sheet placed on the manual feed tray has not been determined, the size of the sheet on the manual feed tray is automatically set to the sheet information of the print job. This can provide a high-efficiency printing apparatus capable of performing printing without causing all the units thereof to return from a sleep mode.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-267328 filed Dec. 6, 2012, which is hereby incorporated by reference herein in its entirety.

What is claimed is:

1. A printing apparatus comprising:

a power control unit configured to control power supply to an operation unit, an engine unit, and a controller unit; and a receiving unit configured to receive a job, wherein the power control unit supplies power to the controller unit and the engine unit so that printing based on the received job is performed based on a sheet size designated in the received job while maintaining restriction on power supply to the operation unit, in a case where the receiving unit receives the job while the printing apparatus is in a first power state which restricts power supply to the operation unit, the engine unit, and the controller unit, and wherein the operation unit displays a screen for setting a sheet size so that printing based on the received job is performed based on the sheet size set via the displayed screen, in a case where the receiving unit receives the job while the printing apparatus is in a second power state which does not restrict power supply to the operation unit, the engine unit, and the controller unit.

2. The printing apparatus according to claim 1, further comprising:

a detecting unit configured to detect a size of a sheet held in a sheet holding unit; and a determining unit configured to determine whether the sheet size designated in the received job and the size of the sheet detected by the detecting unit match each other.

3. The printing apparatus according to claim 2, wherein, in a case where the receiving unit receives the job while the printing apparatus is in the first power state and the determining unit determines that the sheet size designated in the received job and the size of the sheet detected by the detecting unit do not match each other, the power control unit supplies power to the operation unit so that the operation unit displays the screen.

4. The printing apparatus according to claim 1, wherein, after the received job ends, the power control unit stops power supply to both the engine unit and the controller unit.

5. A method for controlling a printing apparatus, the method comprising:

controlling power supply to an operation unit, an engine unit, and a controller unit; and receiving a job, wherein power is supplied to the controller unit and the engine unit so that printing based on the received job is performed based on a sheet size designated in the received job while maintaining restriction on power supply to the operation unit, in a case where the job is received while the printing apparatus is in a first power state which restricts power supply to the operation unit, the engine unit, and the controller unit, and wherein the operation unit displays a screen for setting a sheet size so that printing based on the received job is performed based on the sheet size set via the displayed screen, in a case where the job is received while the printing apparatus is in a second power state which does not restrict power supply to the operation unit, the engine unit, and the controller unit.

6. A computer-readable storage medium storing a computer program to control a printing apparatus to perform a method, the method comprising:

controlling power supply to an operation unit, an engine unit, and a controller unit; and receiving a job, wherein power is supplied to the controller unit and the engine unit so that printing based on the received job is performed based on a sheet size designated in the received job while maintaining restriction on power supply to the operation unit, in a case where the job is received while the printing apparatus is in a first power state which restricts power supply to the operation unit, the engine unit, and the controller unit, and wherein the operation unit displays a screen for setting a sheet size so that printing based on the received job is performed based on the sheet size set via the displayed screen, in a case where the job is received while the printing apparatus is in a second power state which does not restrict power supply to the operation unit, the engine unit, and the controller unit.

* * * * *